United States Patent [19]

Todt

[11] 4,294,174

[45] Oct. 13, 1981

[54] VEHICLE SYSTEM WITH SPEED-RESPONSIVE STOP

[75] Inventor: Gerhard H. Todt, Alling-Biburg, Fed. Rep. of Germany

[73] Assignee: Buro Patent A.G., Glarus, Switzerland

[21] Appl. No.: 132,767

[22] Filed: Mar. 24, 1980

[30] Foreign Application Priority Data

Mar. 23, 1979 [CH] Switzerland ..... 2753/79

[51] Int. Cl.[3] ..... B61B 7/8; B61B 7/00

[52] U.S. Cl. ..... 104/250; 74/3; 104/249; 188/63

[58] Field of Search ..... 104/249–251; 188/385, 62, 63; 192/105 BA, 105 CD; 74/3; 193/32, 40

[56] References Cited

U.S. PATENT DOCUMENTS 1,019,281 3/1912 Stasch ..... 188/63
2,864,467 12/1958 Klamp ..... 188/63
3,948,187 4/1976 Moore ..... 104/250

FOREIGN PATENT DOCUMENTS 375234 6/1973 U.S.S.R. ..... 104/250
470448 9/1975 U.S.S.R. ..... 104/250

*Primary Examiner*—Randolph A. Reese
*Attorney, Agent, or Firm*—Karl F. Ross

[57] ABSTRACT

A rail system of the type in which a vehicle runs along a track to carry articles such as goods from one location in an industrial plant or other installation, to another location. At some point along the path an arm is provided for engagement with the vehicle and is swung with an angular velocity determined by the vehicle speed. A centrifugal clutch, effective when the angular velocity exceeds a predetermined level equivalent, say, to the maximum safe speed for the vehicle, can operate a cam to control a spring-loaded stop for the vehicle or car so that the stop can be rendered effective to bring the vehicle to standstill when the sensor detects the excessive speed.

10 Claims, 3 Drawing Figures

VEHICLE SYSTEM WITH SPEED-RESPONSIVE STOP

FIELD OF THE INVENTION

My present invention relates to a vehicle system of the type in which a plurality of cars, carriages or like vehicles can be directed along a path formed by a track, e.g. in industrial plants or other installations in which cars can carry goods, semifinished articles or other objects from one point to a given destination and, more particularly, to a system of this type provided with means for preventing the vehicle from exceeding a predetermined maximum safe speed.

BACKGROUND OF THE INVENTION

Vehicle systems in which a carrier for articles and objects of diverse types is movable along a track are disclosed for example, in U.S. Pat. No. 3,948,187 and generally comprise a track which can be endless and establishes a path along which the carrier can be propelled or can move in free or gravitationally-induced movement.

The carrier may be one of a number of carriers which can have selector means enabling a variety of destinations along the path to be selected, and various stations can be provided along the path for introducing carriers, as individual vehicles, onto the path or withdrawing the vehicles from the path.

The aforedescribed systems have found application wherever an organized distribution or delivery of raw, semifinished or finished materials is required in manufacturing plants to assist in the collection and distribution of objects in commercial and governmental installations, and to enable access to inventoried stock in warehousing and like applications.

The vehicles themselves may be self-propelled, may be entrained over a portion of the path by conveyors or drive members of diverse type, and may move over at least a portion of the path by inertia or gravitational action.

It has been found to be desirable to provide a stop device along the path of such carriers or vehicles which responds to an excessive vehicle speed, e.g. a speed of the vehicle above a predetermined speed which may be the maximum safe speed of the vehicle.

In the aforementioned patent, for example, an arm extends into the path of the vehicles and is engaged thereby to activate a pin which is released when the vehicle exceeds the predetermined limiting speed so that a latch disengages a gravitationally biased member which swings into the path of the carrier to stop the latter.

While this system has been found to be highly effective, there are some difficulties which are inherent in its construction which have impeded its use. For example, the reliance upon gravitational forces precludes positioning the stop device except in horizontal-track applications. Furthermore, the frictional release mechanism must overcome significant frictional forces to be effective and these forces tend to increase as the release or latch mechanism becomes contaminated with dirt. As a result, the threshold velocity of the vehicle at which the device responds, tends to increase with time.

OBJECTS OF THE INVENTION

It is the principal object of the present invention to provide an improved stop device, especially for a vehicle or carrier system of the aforedescribed type, which is free from the disadvantages of the earlier system discussed above.

Another object of this invention is to provide a stop device for track-borne vehicles responsive to the vehicle speed and which does not vary as to its response threshold with time.

Still another object of my invention is to provide a vehicle system with a stop device performing the functions described and in which the stop device is relatively simple, is highly reliable, and has greater versatility than prior art arrangements.

It is also an object of this invention to provide a stop device for a vehicle system which can be utilized in practically any position of the track, including the horizontal, which responds with little actuation force, and which affords reliable response at a given threshold which does not materially alter with time.

SUMMARY OF THE INVENTION

These objects and others which will become more readily apparent hereinafter are attained, in accordance with the present invention, in a vehicle system of the aforedescribed type for an arm adapted to project into the vehicle path and swingable about an axis transverse to the path, e.g. an axis perpendicular to the plane of the track but disposed alongside the latter, a centrifugal clutch connected to this lever and responsive to the angular velocity thereof about this axis, the clutch having a coupling point establishing the velocity threshold of the vehicle (in terms of the angular velocity of the lever) to which the device will respond, and a spring-biased stop member actuated by said centrifugal clutch upon the detection of excessive speed, for engagement with the vehicle to bring the latter to standstill.

According to the invention, therefore, the spring-biased member does not depend upon orientation to be effective and since a centrifugal clutch establishes the threshold as a function of the angular velocity at which it is activated, there is no structure which can change this threshold with time even if the apparatus is exposed to a high degree of contamination. The centrifugal clutch can be accelerated rapidly to the threshold angular velocity with a minimum of force so that the force encountered by the vehicle upon contact with an acceleration of the arm, is minimal.

Experience has shown that the stop device is reliable and responds at an unaltered threshold velocity after extremely large numbers of test cycles.

According to a feature of the invention, the actuating device between the centrifugal clutch and the spring-loaded stop member, comprises a cam formed on or fixed to the output side of the centrifugal clutch which engages a cam follower. The cam follower may be formed on the end of the spring-biased stopping member which may be spring loaded by a coil spring perpendicular to the axis described previously and hence parallel to the track. According to the invention, detent means is provided to retain the stop element in its ineffective position against the biasing force of the spring, advantageously a torsion spring, the detent being released by the cam of the centrifugal clutch. When the stop element is also resiliently supported so that it can yield in the direction in which the vehicle advances, e.g. via a further spring or the aforementioned torsion spring, the possibility of damage to the vehicle because of a sudden or sharp encounter with the stop element is minimized.

It has been found particularly advantageous to form the stop element as a metal rod bent in the form of an "L" with its long shank disposed parallel to the track and along the path while the short leg can swing into the path upon release of the detent. The long leg can be surrounded by the torsion spring and the axially effective compression spring and can be provided with a transverse pin which is receivable in a notch to form the detent therewith. The long leg of the rod can also be provided with a bent end (finger) which is engageable with the cam of the actuating device.

The device can also coact with a switch which can trigger a signal alerting a system operator to the actuation of the device and hence to a failure at the particular location at which the stop element has been triggered.

The term "vehicle" as used herein should be understood in its most general sense and, of course, includes self-propelled vehicles as well as other cars, carriages or carriers. The vehicle may be mounted on a track which can comprise rails, or can be guided along a path forming a track. The energy for propelling the vehicle may be picked up from a conductive rail or may derive from a source carried by the vehicle. The vehicle may also be entrained by a chain, friction wheel or other drive along a path. The stop system is thus effective upon a failure of the drive mechanism or braking system of the vehicle, when the vehicle is improperly disengaged from a drive system, or when the vehicle is accelerated by gravity or otherwise, e.g. in a vertical or downhill stretch, because of some other malfunction. Preferably, the system is used with self-propelled and self-braking vehicles.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 2:
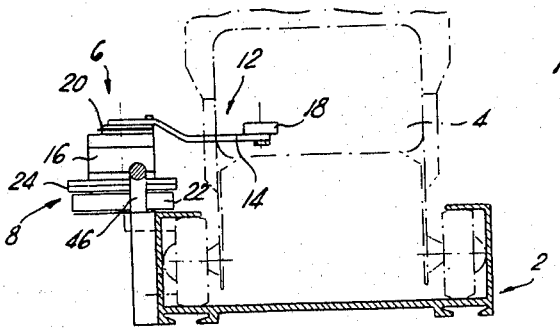
FIG. 2 is a cross-sectional view taken along the line II—II of FIG. 1.

The drawing shows a vehicle and rail system having a fully mechanical stop device which has been shown along a vertical stretch of the system. It should be understood that any other orientation of the mechanism is also possible.

The vehicle system comprises a track 2 along which a vehicle (car, carriage or carrier) 4 is guided, the vehicle being of the self-propelled and self-braking type. It will be assumed, for the sake of this description, that the vehicle may pass the location shown with proper control below the threshold velocity or, with a failure of the internal controls, at a speed exceeding the threshold velocity which may be a maximum safe or permissible speed at the location indicated.

The stop mechanism comprises a sensor 6 for the vehicle speed which is coupled to an actuator 8 for a stop element 10 which can be inserted into the vehicle path to engage the vehicle and bring the same to a standstill.

The fully mechanical speed detector 6 comprises a mechanical sensor 12 in the form of a lever 14 pivotally connected to a centrifugal clutch 16. The centrifugal clutch can be of conventional design and advantageously is of the kind used in the take-up rolls of automotive-vehicle safety belts.

Figure 1:
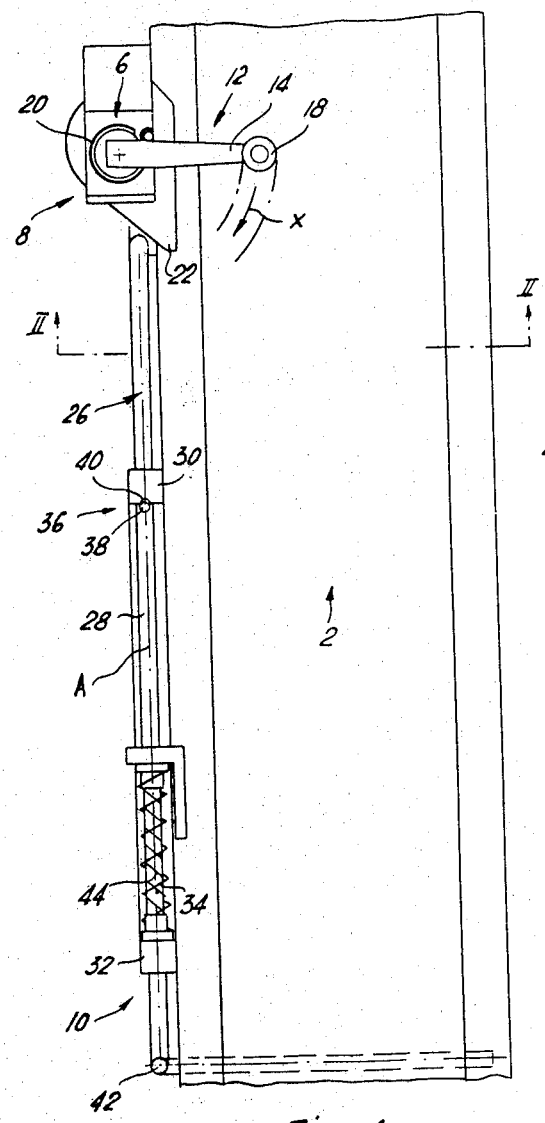
FIG. 1 is a front elevational view of the stop mechanism of the present invention as applied to a vertical stretch of a vehicle system.

The lever 14 is provided with a roller 18 on its free end to engage and roll along the front end and lateral flank of the vehicle 4, the passing vehicle thereby swinging the arm 14 in the clockwise sense (arrow X) as seen in FIG. 1. A torsion-type storing spring 20 passes the lever into the position shown in FIG. 1.

The mechanical sensor cooperates with the actuating mechanism 8 having a control cam 22 connected to the output element 24 of the centrifugal clutch 16. The cam 22, which is shown in its starting position in FIG. 1, is entrained in the clockwise sense by the lever 14 when its angular velocity exceeds the threshold angular velocity for engagement of the clutch.

The cam 22 engages a finger 46 bent perpendicularly to the longitudinal dimension of the long shank 28 of the actuating rod 26 forming the stop member 10 mentioned previously.

Figure 3:
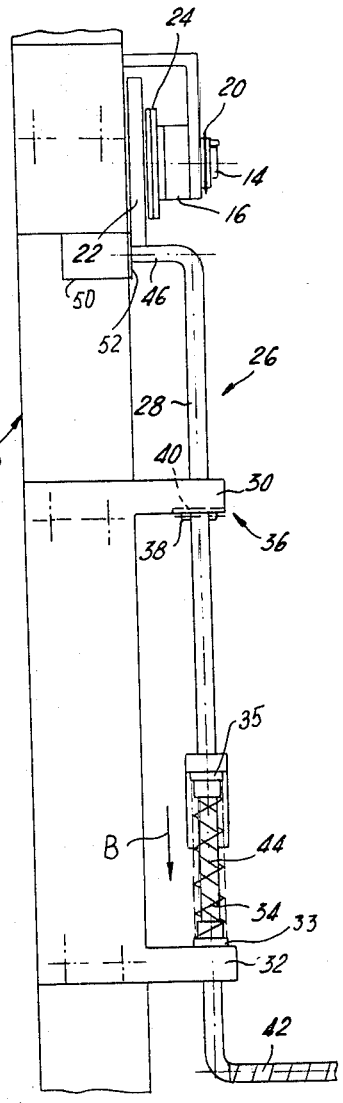
FIG. 3 is a left-side elevational view of the mechanism shown in FIGS. 1 and 2.

The bent rod 26 has an L-configuration as shown in FIG. 3 with its shank 28 extending longitudinally over and parallel to the track 2 and is slidable in a pair of trunnions 30 and 32, while being rotatable therein as well.

A coil spring 34 is seated against a collar 35 on the shank 28, and a boss 33 on the trunnion 32 so as to enable the rod 28 to yield in the direction of arrow B when the short leg 42 of this rod engages the vehicle.

A detent 36 allows the spring 34 to maintain a prestress and thereby limits the displacement of the shank 28 in the direction opposite to the arrow B.

The detent 36 comprises a transverse pin 38 in the shank 28 which is received in the notch 40 of the trunnion 30 to limit both angular displacement of the shank 28 and its axial displacement.

The shank 28 is, however, angularly biased for clockwise rotation about its longitudinal axis A, by a torsion spring 44 coaxial with the spring 34 and stressed to swing the bent rod 26 as described upon release of the pin 38 from the notch 40.

Since the force of spring 34 is sufficient to hold the pin 38 in the notch 40, the torsion spring is not effective until the cam 22 rotates the rod 26 sufficiently to drive the pin 38 out of the notch 40.

In operation, a vehicle 4 traveling along the rail 2 at normal speeds encounters the arm 14 and swings it with an angular velocity in the clockwise sense (FIG. 1) below the threshold velocity. The vehicle passes without affecting the mechanism otherwise.

When a vehicle traveling at excess speed encounters the arm 14, e.g. because of a brake failure, the arm is swung with an angular velocity exceeding the threshold velocity of the clutch, thereby entraining the cam 22 in the clockwise sense and releasing the pin 38 from the notch 40. The torsion spring 44 then swings the rod 26 about the axis A in the clockwise sense (FIG. 2) to lay the leg 42 across the track 2 and engage the vehicle 4. The impact of the vehicle upon the rod 26 is taken up by movement of the rod 26 in the direction of arrow B and against the force of spring 34. A switch 50, whose actuator 52 is in the path of the finger 46, signals the service attendant for the vehicle system that the stop mechanism has been actuated. The mechanism is reset by hand once the defective vehicle has been removed from the track. The system is thus not dependent upon any energy source.

I claim:

1. A mechanical stop mechanism for a vehicle system having a track defining a vehicle path and at least one vehicle displaceable along said path, said mechanism comprising:

an arm pivotally mounted alongside said path at an axis transverse thereto and adapted to extend into said path for engagement by said vehicle whereby said arm is swung by said vehicle about said axis at an angular velocity determined by the speed of said vehicle;

a centrifugal clutch having an output element, said clutch being connected to said arm and having a threshold velocity for clutch engagement whereby said output element of said clutch is rotatably entrained by said arm upon the angular velocity thereof exceeding said threshold velocity;

a restoring spring connected to said arm for biasing same into a position wherein said arm extends into said path; and a stop member triggered upon movement of said output element into a position wherein said stop member engages said vehicle and holds the same along said path.

2. The mechanism defined in claim 1 wherein said output element is provided with a cam engageable with said stop member for actuating same.

3. The mechanism defined in claim 2, further comprising resilient means acting upon said stop member for yieldably absorbing movement of said stop member in the direction of travel of said vehicle.

4. The mechanism defined in claim 3, further comprising a detent releasably retaining said stop member, said cam disengaging said detent, said stop member being provided with a further spring for swinging same into an effective position upon release of said detent whereby said stop member engages said vehicle.

5. The mechanism defined in claim 4 wherein said stop member comprises an L-shaped bent rod having a long shank parallel to said track and axially shiftable therealong and rotatable about its axis, and a short leg adapted to extend across said track for engagement with said vehicle.

6. The mechanism defined in claim 5 wherein said detent includes a pin carried by said shank and engageable in a notch formed in a trunnion slidably and rotatably receiving said shank.

7. The mechanism defined in claim 6 wherein said shank is provided with a finger engageable by said cam.

8. The mechanism defined in claim 1, claim 2, claim 3 or claim 4 wherein said stop member comprises a bent metal rod having a long shank, a finger bent at right angles to said shank at one end and cooperating with said output element to rotate said shank, and a short leg bent at right angles to said shank at the opposite end of said stop member and swingable across said track for engagement with said vehicle, said mechanism further comprising a pair of trunnions rotatably and slidably supporting said shank, a torsion spring surrounding said shank and biasing said leg toward a position wherein said leg extends across said track, and an axially effective spring surrounding said shank for absorbing sliding displacement of said shank upon engagement of said vehicle by said leg.

9. The mechanism defined in claim 8 wherein said shank is formed with a pin and one of said trunnions is provided with a notch receiving said pin by holding said shank against angular displacement until said output element engages said finger, thereby stressing said torsion spring.

10. The mechanism defined in claim 9, further comprising means responsive to displacement of said output element for signaling the operation of said mechanism.

* * * * *